United States Patent [19]

Glickman

[11] Patent Number: 4,897,292

[45] Date of Patent: Jan. 30, 1990

[54] BRANCH-HOLDER ASSEMBLY FOR ARTIFICIAL CHRISTMAS TREES

[75] Inventor: Joel I. Glickman, Huntingdon Valley, Pa.

[73] Assignee: Magic Mold Corporation, Hatfield, Pa.

[21] Appl. No.: 292,816

[22] Filed: Jan. 3, 1989

[51] Int. Cl.[4] ..... A47G 33/06

[52] U.S. Cl. ..... 428/8; 211/205; 428/20

[58] Field of Search ..... 211/196, 205; 428/8, 428/18, 19, 20

[56] References Cited

U.S. PATENT DOCUMENTS

| | | | |
|---|---|---|---|
| 3,115,435 | 12/1963 | Abramson | 428/8 |
| 3,829,349 | 8/1974 | Hermanson | 428/8 |
| 4,343,842 | 8/1982 | Chase | 428/8 |
| 4,451,510 | 5/1984 | Boisvert et al. | 428/8 |
| 4,468,421 | 8/1984 | Wang | 428/8 |

*Primary Examiner*—Henry F. Epstein

*Attorney, Agent, or Firm*—Schweitzer & Cornman

[57] ABSTRACT

An artificial Christmas tree with folding branches is disclosed. A special form of branch-mounting sleeve and adapter element allow pivoting action to be achieved while enabling the use of conventional, readily-available bent wire branch elements. The adapter element is initially assembled with the bent wire branch, after which the adapter is snapped onto a pivot bar formed by the branch mounting sleeve. The branch wire and adapter are inseparably assembled once the adapter is pivotally attached to the sleeve. Considerable savings are realized by the ability to use conventional bent wire branches.

7 Claims, 2 Drawing Sheets

BRANCH-HOLDER ASSEMBLY FOR ARTIFICIAL CHRISTMAS TREES

BACKGROUND AND SUMMARY OF THE INVENTION

In the construction of artificial Christmas trees, one of the convention techniques is to provide a central pole supported vertically by a suitable mounting stand. A series of sleeves is received over the central pole to provide for the mounting of artificial branches, and spacing between levels of branches.

The branch structure for many of the artificial tree designs includes a wire element having a short, generally vertical mounting section and which is bent at an angle to provide a radially outwardly and slightly upwardly extending branch arm or limb portion that mounts the artificial needles, and in some cases, subsidiary branching. Branch elements for the lower portion of the tree are, of course, of a relatively substantial length, with the length of branches at successively higher levels becoming progressively shorter to provide the traditional conical Christmas tree configuration.

Typically, the mounting sleeves for the branch structure are provided with a series of radially spaced vertical bores, to receive the vertical mounting portions of the branch wires. In addition, the inner limb portions of the branch wires may be received in radially spaced, upwardly inclined grooves or channels, which serve both to radially orient the branches and to provide additional support to the inner portions thereof.

Because artificial trees are intended to be reused, year after year, provision is usually made for removal of the individual branches from their mounting sockets, to enable the components of the tree to be packed away in a conveniently small space. In the most common forms of artificial Christmas trees, the disassembly/reassembly operation can involve considerable time, not only because of the time required to assemble a relatively large number of branches into their respective mounting sleeve elements, but also because the branches are of different sizes and must be assembled at the proper level on the tree. Efforts have been made, of course, to construct artificial Christmas trees to have a folding branch structure so that, ideally, putting away of the artificial tree for the next season can be accomplished by simply folding the branches upwardly, close in to the central pole. Examples of prior attempts to construct such folding trees are represented by the Abramson U.S. Pat. No. 3,115,435, the Hermanson U.S. Pat. No. 3,829,349 and the Wang U.S. Pat. No. 4,468,421. The structures of these representative patents, while presumably serving the basic purpose of providing a foldable structure, all require the use of special, non-standard branch constructions, so that special branch-making machinery is required to carry out these designs. That requirement impacts very negatively on the economics of the production and marketing of trees of this type.

In accordance with the present invention, a novel and improved structural arrangement is provided for artificial Christmas trees and the like, which provides for permanently or semipermanently assembled branches which fold upwardly for storage, yet which accommodates the use of conventionally manufactured bent wire branch elements, produced by conventional, existing machinery. The construction of the invention thus enables, full utilization to be made of the significant installed base of branch-making machinery.

In accordance with a more specific aspect of the present invention, a foldable branch mounting arrangement is provided which includes a branch-mounting sleeve formed with !5 a plurality of radially oriented branch receiving slots and further includes special branch-receiving adapter elements arranged to be pivotably mounted by the sleeve. The adapters and sleeve are of molded plastic construction, and the adapters are specially constructed to receive the base portions of conventionally configured bent wire branches.

In accordance with the invention, the branch-holding adapter is arranged to be assembled with a branch element while separate and independent from the mounting sleeve. After joining the branch to the adapter, the adapter is inserted in one of the branch-receiving slots of a mounting sleeve and secured therein for pivoting movement. The geometry of the adapter is such as to provide substantial support for the branch in its normal position, while allowing upward pivoting of the branch for storage of the tree between seasons.

To particular advantage, each of the branch-receiving radial slots of the branch mounting sleeve is provided with a horizontal pivot bar. The adapters are provided with open-sided bores for the reception of such pivot bars, to provide for the support and pivoted mounting of the branches and their adapters. A snap-in assembly is accommodated by this design, so that the parts may be easily assembled in the first instance but will remain permanently assembled unless there is a special reason for disassembly.

For a better understanding of the above and other features and advantages of the invention, reference should be made to the following detailed description of a preferred embodiment, and to the accompanying drawing.

DESCRIPTION OF THE PREFERRED EMBODIMENT

Figure 1:
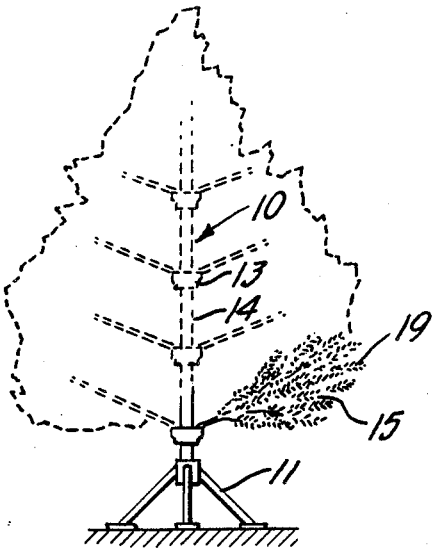
FIGS. 1 and 2 are simplified, schematic representations of an artificial Christmas tree of the type contemplated by the present invention, illustrating the tree in its normal display position (FIG. 1) and in a folded position (FIG. 1).
Figure 2:
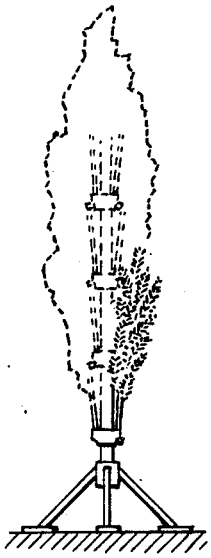

Referring now to the drawing, the reference numeral 10 designates generally the trunk assembly of an artificial tree, which is supported by a suitable base 11. The trunk assembly typically includes a central support pole 12, a plurality of branch support sleeves 13, and intervening spacer sleeves 14. In some cases, the spacer sleeves 14 may be eliminated, with other means being provided to locate the branch-mounting sleeves 13 at various appropriate locations along the vertical height of the central pole 12. Individual branches 15 are supported in a radially spaced array by each of the branch-mounting sleeves 13, in a known configuration.

With the structure of the invention, the individual branches 15 may be, and advantageously are, of a well-known, conventional construction. To this end, the branches are wire construction, possibly of solid wire, as shown in the drawings, or perhaps, more typically, of a twisted wire construction, such as shown in the Chase U.S. Pat. No. 4,343,842, for example. In either case, the branch 15 includes a short, generally vertically oriented mounting portion 16 joined at an arcuate bend 17 with an outwardly and upwardly extending limb portion 18, to which is mounted an arrangement of needles 19. For particularly high quality constructions, the outer portions of each branch may include subsidiary branching, as illustrated in FIG. 1, but that is independent of the subject matter of the present invention.

Figure 3:
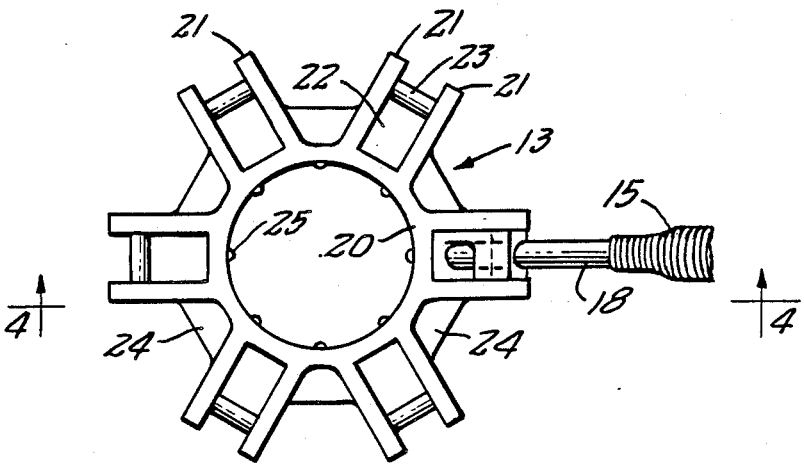
FIG. 3 is an enlarged top plan view of a branch-mounting sleeve constructed according to the invention and mounting a branch and adapter.
Figure 4:
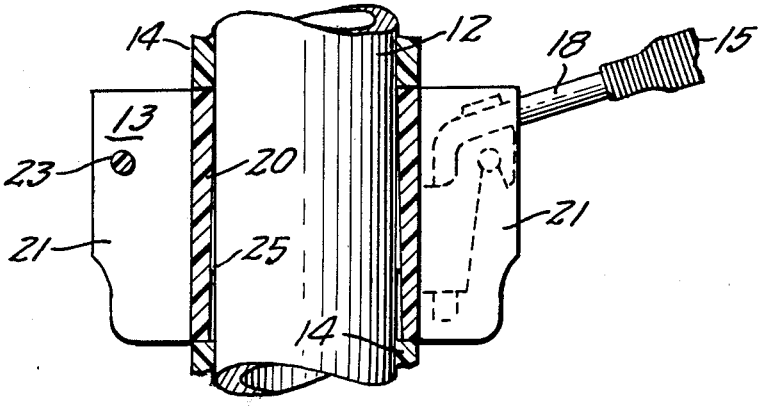
FIG. 4 is a cross sectional view as taken generally on line 4—4 of FIG. 3.
Figure 5:
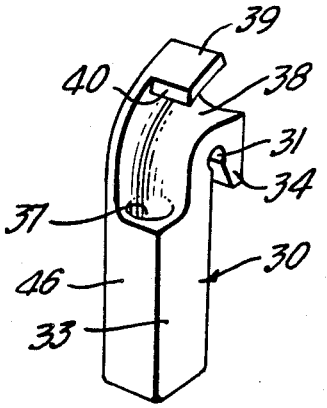
FIG. 5 is a perspective view illustrating a branch-mounting adapter constructed according to the invention.
Figure 6:
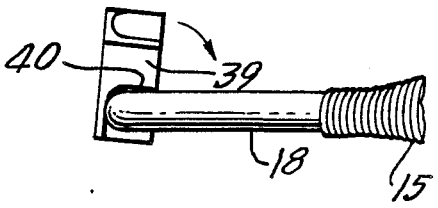
FIGS. 6 and 7 are sequential top views illustrating the manner in which a conventional branch is assembled together with the adapter of FIG. 5.
Figure 7:
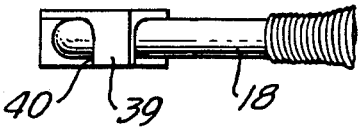

With reference now to FIGS. 3 and 4, the branch-mounting sleeve preferably utilized in the practice of the invention is formed of injection molded plastic material, such as rigid PVC, and includes a central, cylindrical portion 20 from which project a plurality of pairs of recess forming walls 21, each pair forming between them a radially oriented vertical recess 22. The inside walls of the recesses 22 are formed by H) the outer surface of the cylindrical sleeve portion 20. At least the upper and outer portions of the recesses are open, and for the purpose of simplicity also preferably the bottoms as well.

In the illustrated device, there are six pairs of recess forming walls 21, arranged at angles of 60 degrees. The particular geometry, however, will be a function of the size of the tree and other factors.

Extending between each of the walls 21 of a recess-forming pair is an integral cylindrical pivot bar 23, which is arranged to form a pivot support for the tree branch structure, to be further described. Between each adjacent, angularly disposed pair of recess forming walls 21 is a strengthening web 24.

To facilitate molding of the product, the walls of the cylindrical portion 20 may taper slightly from top to bottom, in which case the sleeve may be provided internally with a series of tapered ribs 25 to provide snug support with the outer wall of the central tubular post 12.

In accordance with the invention, a novel and improved branch-holding adapter element 30 is provided, which is arranged to receive and retain a branch of conventional, bent wire construction and to enable such conventional branch to be pivotally mounted within each recess 22 of the branch-mounting sleeve 13. The adapter element 30, shown in detail in FIGS. 5–9 of the drawing, is ideally of injection molded construction, typically of the same material used in the molding of the sleeve 13. The adapter is formed with a horizontal, cylindrical bore 31, extending from side to side and partially open along its bottom side 32, below the diameter of the circular section, so that the opening 32 is somewhat smaller than the diameter of the bore.

As reflected in the drawing, the adapter 30 is somewhat in the form of an inverted "J", including a downwardly extending support leg 33 of considerable length and a short, downwardly projecting front leg 34.

The front surface 35 of the support leg 33 and the rearwardly facing surface 36 of the short front leg 34 desirably define a convergent guide leading to the restricted opening 32 into the bore 31. This arrangement facilitates assembly of the adapter to the mounting sleeve 13, as will be further described.

The side-to-side thickness of the adapter 30 is substantially the same as the width of the recesses 22, such that, when the adapter is inserted in one of the recesses 22, it is closely confined therein.

In accordance with the invention, the support leg 33 is provided with a vertical recess 37. Desirably, the recess is in the form of a bore of a size to closely and snugly receive the vertically-extending mounting portion 16 of the branch wire. Further, the adapter is provided with an open-sided recess 38 of a size and shape to conform generally to the arcuate portion 17 and inner limb portions of the branch wire. The recess is defined on the top by an integral plastic abutment tab 39, which extends generally horizontally from one side of the adapter and is arranged to overlie inner limb portions of the branch wire 18 in the assembled device. As reflected particularly in FIG. 8, the rearward edge extremity 40 of the abutment tab is generally aligned with the front extremity of the vertical bore 37. This provides vertical clearance which enables the branch 15 to be assembled with the adapter. This is done by first orienting the adapter and branch at right angles to each other (see FIG. 6) and then inserting the mounting portion 16 of the wire vertically downward into the adapter recess 37. Once the branch wire is properly positioned in the recess 37, the adapter and wire may be rotated into alignment (see FIG. 7). In this aligned position, the wire is restricted against vertical removal from the adapter bore 37 by the presence of the overlying abutment tab 39.

To advantage, the adapter 30 is shaped with an upwardly facing arcuate support surface 41 adapted to conform to the inside radius of the curved portion 17 of the branch wire, such that, after the wire is properly assembled with the adapter, the wire is retained snugly between the abutment tab 39 and the arcuate surface 41. At the forward extremity of the adapter, the lower surface 42 may advantageously diverge slightly from the confining surface of the abutment tab 39 to accommodate slightly varying bend angles of the branch 15.

Figure 8:
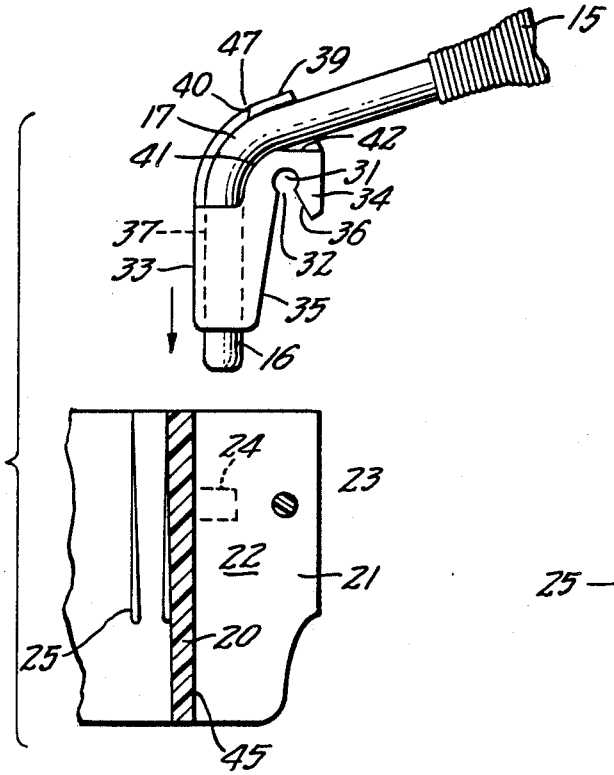
FIG. 8 is an illustration of the procedure for assembly of a branch and its adapter to the branch-mounting sleeve of FIG. 3.

Pursuant to the invention, after mounting of the adapter 30 at the base end of the branch wire, the adapter is assembled to the branch-mounting sleeve 13 by aligning the parts substantially in the manner shown in FIG. 8 and pressing the assembled branch and adapter downwardly with sufficient force to cause the pivot bar 23 to snap into the bore 31. In this respect, there is sufficient resilience in the plastic material of which the adapter is formed to allow the front portion to deflect outwardly enough to accommodate the snap-in assembly operation.

Figure 9:
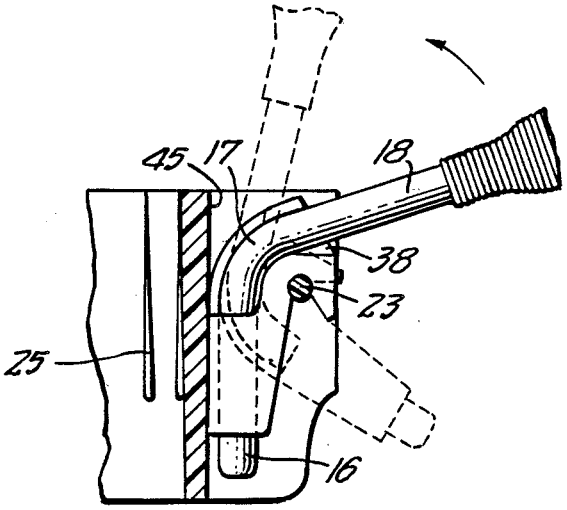
FIG. 9 is a fragmentary cross sectional illustration, showing the branch and adapter mounted in the sleeve, and illustrating the normal and folded positions of the branch.

As reflected in FIG. 9, the spacing between the pivot bar 23 and the back wall 45 of the recess 22 equals the distance between the adapter bore 31 and the adapter back wall 46 such that, when the adapter is properly seated on the pivot bar 23, the support leg 33 and the wire mounting portion 16 inserted therein are supported in a substantially vertical orientation. In this respect, it will be understood that the downward weight upon the outer portion of the branch will tend to pivot the outer portion downward which will, in turn, press the support leg 33 of the adapter firmly against the back wall 45 of the recess 22.

As reflected in FIG. 9, for example, the recess-forming walls 22 extend outward a sufficient distance to completely enclose the adapter 30 so as to provide firm side-to-side support thereof. In addition, the side opening recess 38 of the adapter is confronted by the adjacent recess-forming wall 21 so that, after assembly of the adapter onto the pivot bar 23, the branch wire 18 can no longer be swung at right angles to the adapter. Accordingly, it is no longer possible to remove the branch wire independently of the complete assembly of branch wire and adapter. In order to separate the branch wire from the adapter, it is first necessary to detach the assembly from the pivot bar 23, remove it from the recess 22 and then effect disassembly of wire and adapter. In normal usage, this will not take place, as it is intended that the adapters 30 will remain permanently attached to their respective pivot bars 23 in normal usage.

For dismantling and/or storing of the tree after usage, the branches 15 may be pivoted upward, to a position such as shown in dotted lines in FIG. 9. To this end, the upper arcuate contours of the adapter, as indicated at 47 (FIG. 8) forms a radius about a point preferably located below the axis of the pivot bar 23, so as to provide assured clearance along the recess inner wall 45, when the branch and adapter are pivoted upwardly.

Of particular significance in the apparatus of the present invention is the ability to utilize branch structures of wholly conventional and widely utilized configuration. In this respect, the need for utilizing special branch configurations in order to accommodated pivoting action of the branches for stow-away purposes constitutes a major economic impediment to commercial adoption of such designs. The arrangement according to the invention, by providing a unique and advantageous adapter element, enables the fold-away construction to be incorporated in an artificial Christmas tree while at the same time allowing conventional branching to be utilized. The mounting sleeve and adapter element may be economically produced by high volume, injection molding procedures and the necessary assembly operations to join the adapter to the conventional branching may be easily and quickly accomplished.

One of the very desirable features of the new adapter element resides in the provision of an open-sided recess for receiving the arcuate portion of the branch wire while allowing the branch wire to be confined at the top against separation from the adapter. The initial assembly is enabled by rotationally orienting parts at an angle to each other to accommodate insertion of the wire to the adapter. Thereafter, after the assembled adapter and wire have been joined with the mounting sleeve, the open sided recess is effectively closed by a confronting surface of the recess-forming wall in the mounting sleeve.

It should be understood, of course, that the specific form of the invention herein illustrated and described is intended to be representative only and certain changes may be made therein without departing from the clear teachings of the disclosure. Accordingly, reference should be made to the following appended claims in determining the full scope of the invention.

I claim:

1. A pivotally foldable branch structure for an artificial Christmas tree or the like comprising (a) a branch-mounting member provided with a plurality of radially oriented recesses each defined by spaced walls, (b) pivot support means in said recesses, (c) a plurality of bent wire branch elements having downwardly extending mounting portions and outwardly extending limb portions, (d) pivotable adapter elements for said bent wire branch elements, (e) said adapter elements each having a downwardly extending recess for the reception and containment of the mounting portions of said branch elements and an open-sided, outwardly extending recess, adjacent the top of said downwardly extending recess, for the reception of inner limb portions of said branch elements, (f) said adapters being received in said recesses and supported by said pivot support means for pivoting movement about a horizontal axis to move said limb portions in an upward direction, (g) the open-sided recesses of said adapters being effectively closed off by confronting surfaces of the spaced walls of said radially oriented recesses, whereby the limb portions of said branch elements are locked into said adapter elements when said adapter elements are mounted on said pivot means.

2. A foldable branch structure according to claim 1, further characterized by (a) said adapter elements being of inverted J-shaped configuration, and including a horizontal bore in the upper portion of the inverted J-shaped element, (b) said J-shaped element including an elongated downwardly extending element adapted to bear radially inward against said branch-mounting member and containing said downwardly extending recess.

3. A foldable branch structure according to claim 2, further characterized by (a) said adapter element being of molded plastic construction and being formed with a downwardly facing divergent opening communicating with said bore, and (b) said adapter elements being adapted for resilient press fit assembly to said pivot means.

4. A foldable branch structure according to claim 1, further characterized by (a) said adapter including an abutment tab extending over the top of and forming an upper wall portion of said open-sided recess, whereby to prevent separation of said branch elements from said adapters when said adapters are mounted in said recesses.

5. A foldable branch structure according to claim 1, further characterized by (a) said branch-mounting element comprising a sleeve-like member of molded plastic construction having pairs of outwardly extending walls forming said recesses, (b) said pivot means comprising horizontal cylindrical elements molded integrally with said sleeve-like member and bridging said recesses, (c) said adapter elements being of molded plastic material and of inverted J-shaped configurations defined by elongated, downwardly extending support leg portions, shorter, downwardly extending outer leg portions, and a loop portion between said leg portions, and (d) said loop portions defining downward opening, horizontally oriented cylindrical recesses adapted for snap-fit assembly with said pivot means.

6. A foldable branch structure according to claim 1, further characterized by (a) said downwardly extending recesses being of closed cylindrical configuration for the reception of the mounting portions of said branch elements, and (b) said adapter elements being free of obstruction directly above the upper ends of said downwardly extending recesses, to accommodate vertically downward insertion of branch elements into said recesses.

7. A foldable branch structure according to claim 6, further characterized by (a) said open sided recesses being defined in part by abutment tab means located directly above the inner ends of said limb portions to preclude vertical separation of said branch elements from said adapter elements.

* * * * *